US010391664B2

(12) United States Patent
Thies

(10) Patent No.: US 10,391,664 B2
(45) Date of Patent: Aug. 27, 2019

(54) DEVICE AND METHOD FOR PRODUCING BAGS

(75) Inventor: Joerg Christian Thies, Dissen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 1071 days.

(21) Appl. No.: 12/736,427

(22) PCT Filed: Apr. 7, 2009

(86) PCT No.: PCT/EP2009/054136
§ 371 (c)(1),
(2), (4) Date: Dec. 23, 2010

(87) PCT Pub. No.: WO2009/124929
PCT Pub. Date: Oct. 15, 2009

(65) Prior Publication Data

US 2011/0143901 A1 Jun. 16, 2011

(30) Foreign Application Priority Data

Apr. 7, 2008 (DE) ..... 10 2008 017 726

(51) Int. Cl.

| | |
|---|---|
| ***B26F 1/24*** | (2006.01) |
| ***B26F 1/04*** | (2006.01) |
| ***B31B 70/00*** | (2017.01) |
| *B31B 160/10* | (2017.01) |
| *B31B 70/14* | (2017.01) |
| *B31B 155/00* | (2017.01) |

(52) U.S. Cl.
CPC ..... *B26F 1/24* (2013.01); *B26F 1/04* (2013.01); *B31B 70/00* (2017.08); *B31B 70/004* (2017.08); *B31B 70/14* (2017.08); *B31B 2155/00* (2017.08); *B31B 2155/0012* (2017.08); *B31B 2160/10* (2017.08); *Y10T 83/0481* (2015.04); *Y10T 83/21* (2015.04)

(58) Field of Classification Search
CPC ... B26F 1/24; B26F 1/04; B31B 70/00; B31B 2155/00; B31B 70/14; B31B 2155/0012; B31B 70/004; B31B 2160/10; Y10T 83/0481; Y10T 83/21
USPC ..... 493/227, 229, 232, 235, 218
See application file for complete search history.

(56) References Cited

U.S. PATENT DOCUMENTS

| | | | | |
|---|---|---|---|---|
| 3,350,988 | A * | 11/1967 | Schultz | 53/460 |
| 3,390,617 | A * | 7/1968 | Cloud et al. | 493/194 |
| 3,552,278 | A * | 1/1971 | Guenther | 493/196 |
| 3,599,538 | A * | 8/1971 | Piazze | 493/194 |

(Continued)

FOREIGN PATENT DOCUMENTS

| | | |
|---|---|---|
| DE | 647 889 C | 7/1937 |
| DE | 844 110 C | 7/1952 |

(Continued)

*Primary Examiner* — Sameh Tawfik
(74) *Attorney, Agent, or Firm* — Jacobson Holman, PLLC.

(57) ABSTRACT

A device for production of bags that preferably consist mostly of paper includes a perforation device for cross perforation of a material web, a tube formation device for formation of a tube from the material web, a first separation device to separate individual tube sections, a device to form a bottom on one of the ends of the tube section, and a second separation device with which individual material sections can be torn off from the tube sections or bags.

7 Claims, 5 Drawing Sheets

(56) References Cited

U.S. PATENT DOCUMENTS

| | | | | | |
|---|---|---|---|---|---|
| 4,395,254 | A * | 7/1983 | Schuster | 493/196 |
| 4,730,943 | A * | 3/1988 | Johnson | 383/8 |
| 4,790,803 | A * | 12/1988 | Roen et al. | 493/195 |
| 4,820,251 | A * | 4/1989 | Blaser | B26D 3/14 493/1 |
| 4,913,693 | A * | 4/1990 | Ball et al. | 493/194 |
| 4,954,124 | A * | 9/1990 | Erickson et al. | 493/195 |
| 5,765,345 | A * | 6/1998 | Svec | 53/453 |
| 7,410,452 | B2 * | 8/2008 | Nishibe et al. | 493/116 |

FOREIGN PATENT DOCUMENTS

| | | |
|---|---|---|
| FR | 786579 | 9/1935 |
| FR | 1159929 | 7/1958 |
| GB | 482765 | 4/1938 |
| GB | 494 040 A | 10/1938 |

* cited by examiner

XI
XI
50
25
64
63
66
65
61
62
60
69
70
71
72
72'
67
74
73
75

XII - XII
XIII
XIII
50
25
64
63
66
65
61
62
60
70'
71
72
67

XI - XI
50
R
D
60
72
68
65
70
67
69
71
72'
74

XIII - XIII
50
XII
XII
R
60
65
68
70
72
67
71
74
72'

DEVICE AND METHOD FOR PRODUCING BAGS

CROSS-REFERENCE TO RELATED APPLICATIONS

This is a national stage of PCT/EP09/054136 filed Apr. 7, 2009 and published in German, which has a priority of German no. 10 2008 017 726.1 filed Apr. 7, 2008, hereby incorporated by reference.

BACKGROUND OF THE INVENTION

1. Field of invention

The invention concerns a device for production of baqs, and a method for the production of bags that employs the device, as described herein.

2. Description of the Prior Art Devices and methods of the type just mentioned have been known for many years. German Patent DE 720 665 discloses a machine for production of flat or gusseted bags, in which a material web is unwound from a reel, made into a tube and separated into individual tube pieces, each of which is then provided with a bottom.

In a variant shown there a web is initially provided with transverse perforations, in which at each perforation individual perforation sections are offset relative to the other sections in the running direction of the web. After creation of the tube and tear-off of individual tube sections this offset perforation means that parts of the rear wall on one end of the tube section protrude beyond the front wall. This part of the rear wall protruding beyond the front wall is also referred to as a tab. The front wall protrudes beyond the rear wall on the other end accordingly. The perforation is generally configured so that the rear wall protrudes beyond the front wall on the leading end of the tube section. This process is chosen because the tab can then be simply folded back and fastened to the front wall, for example, glued. Parts of the front wall are also often folded together with the tab and glued, which increases the tightness of the bag and the durability of the bottom. The rear wall for this purpose need only run on a nonmoving resistance. The bags produced this way are referred to subsequently as "ordinary bags."

However, in the recent past bags in which a strip of transparent material is introduced in the front wall in the longitudinal direction have increasingly been required. The rear wall folded onto the front wall is generally printed, since the printable surface on the front wall is smaller overall in comparison with ordinary bags. However, it is often also desired in this type of bag that the rear wall also protrudes beyond the front wall on the rear open end in order to be able to easily fill such a bag.

Ordinary bags are simply rotated around the longitudinal axis for this purpose so that the rear wall becomes the front wall and vice-versa. However, the tab with which the bag is closed is then arranged on the (new) rear wall. However, printable area is then lost in bags with a transparent strip.

In order to create a bag as desired, it is therefore required to remove a material section on the open end of the front wall so that the rear wall here also protrudes beyond the front wall.

Machines are already known from practice with which this material section could be removed from the front wall from the trailing end. This occurs together with the work step of separation of a tube section from the tube. The leading end of the tube is grasped by the roll gap of a roll pair, which is often referred to as tear-off roll pair. Since the rolls of this roll pair have higher peripheral speed in the rolls of the last advance roll pair, the tube section tears off along the perforation line. At the same time the part of the front wall protruding beyond the rear wall is grasped and held so that this part tears off from the tube section being separated and also from the new leading end of the tube. An additional roll pair is used to hold this part, the peripheral speed of the rolls being lower than the peripheral speed of the rolls of the tear-off roll pair but greater than the peripheral speed of the rolls of the advance roll pair. These additional rolls can be viewed as an additional tear-off device. Such devices are known from document DE 647 889 B.

The described device, for which no document is known to the applicant, operates very slowly in comparison with devices that produce ordinary bags. The separated part also cannot be reliably removed frequently so that disturbances in the machine up to shutdown can occur. Adjustment of the three mentioned roll pairs relative to each other is very difficult to configure. In addition, the required speed differences often pose problems and restrict possible section lengths.

SUMMARY OF THE INVENTION

The task of the present invention is therefore to propose a device and method for production of bags in which a material part of the front wall is removed, which overcomes the mentioned drawbacks of the described device of the prior art.

The task is solved by a device including the characterizing features described herein, and a method with the characterizing features described herein.

At least one additional tear-off device is therefore provided with which individual material sections can be torn from the tube sections or from the bags.

The basic idea of the present invention, in comparison with the described machines known from the prior art, is not to fundamentally change the separation device for separation of individual tube sections of machines for production of ordinary bags. In order to now be able to separate the material section an additional separation or tear-off device is provided. This additional tear-off device operates independently of the first separation device for separation of individual tube sections but according to the same functional principle. It can even be constructed identically to the first separation device. Separation of a tube section from the tube and separation of the material section therefore occur in two separate work steps in two separate stations. The processing speed known from machines from production of ordinary bags can therefore be retained with the invention, since not only the separation device for separation of individual tube sections can be operated with this speed but so can the additional separation device. Moreover, the device according to the invention operates much more reliably, since a costly device to transport away the torn-off material section need not be provided within the first separation device. The material section can be taken off by one of the rolls that separate the material section. The material section running ahead of a tube section just separated in the separation device or a tube section to be separated in the separation device is preferably torn off from a bag or tube section. The bag or tube section from which the material section is torn off can run directly ahead of the last named tube section or additional tube sections can run in between. A gap therefore exists between two tube sections or two bags in which the material sections are to be separated. This gap is characterized by the fact that no components of the first tube section or the first bag overlap components of the next tube section or next bag. In particular, the material section of the leading tube section to be separated does not overlap the leading tab of the next tube section. In an advantageous variant of the invention it is proposed to arrange the additional tear-off device after a device for forming the bottom. Such a device can be constructed particularly easily from a device for production of ordinary bags by connecting an additional tear-off device. The additional tear-off device can be produced, for example, as an additional module, which is offered and sold as a option or can be even retrofitted later. If such an additional tear-off device is present at the mentioned position, it can also be taken out of operation when ordinary bags are to be produced. A device according to the invention can therefore also be used very flexibly when production of different types of bags is involved.

In an alternative variant it is proposed to move the additional tear-off device in front of the device for forming the bottom. A device produced according to this variant is constructed more compact than the machine described in the preceding paragraph. In this variant it is even conceivable that the material section can be torn off the front end of the tube section. This is only possible in the first practical example if the bottom is formed on the trailing end of the tube section, which is generally avoided because of the comparatively complicated process.

In another embodiment of the invention a device for removal of material sections is provided in the additional tear-off device. This has the task of reliably removing the material section from the transport path of the tube sections or bags so that no inconveniences develop during bag production. This device can include suction devices, tongs or a combination of suction devices and tongs. However, it is preferable that the device for removal of material sections includes at least one needle roll. The mentioned device for removal of material sections can then also consists simply of needles assigned to one of the rolls of the tear-off roll pair so that no additional needle roll is required. These needles could be arranged within the roll and are positioned movable relative to this roll. Because of this it is possible to deploy the needles when the material section is to be picked up and to retract the needles when the material section is to be removed from the roll. Removal of the material sections to be removed from the roll advantageously occurs by means of a suction device.

In an advantageous embodiment it is proposed that the first separation device for separation of individual tube sections, which is also referred to as the first tear-off device in this patent application, include holding devices with which the material section to be torn off later is fixed. Such holding devices are moved so that the material section is at rest relative to the tube section to which this material section belongs. If the material section is situated on the trailing end of the tube section to be torn off, the holding devices must move with the peripheral speed of the rolls of the roll pair that accelerates the tube section being torn off. However, if the tube section is on the leading end of the tube from which the tube section is torn off, the holding devices must move with the transport speed of the tube. The peripheral surfaces of additional rolls are preferably considered as holding devices. Additional holding devices can optionally be dispensed with, if the tear-off roll pair or the advance roll pair grasps the tube section to be torn off or the next tube directly in the area of said material section.

It should be mentioned in this context that, wherever rolls are mentioned anywhere in this application, any revolving transport devices are conceivable, like conveyor belts, which are guided over several rollers or rolls and ultimately satisfy the same purpose as the aforementioned rolls.

In a preferred embodiment of the invention it is proposed that the second tear-off station be drivable with a drive separated from the drive of the main machine. In order to be able to expand the mentioned device by a second tear-off station, no linkage need be produced between the drive of the actual machine and the second tear-off station. This facilitates assembly work.

It is also advantageous if the second tear-off station is arranged in a machine frame that is independent of the machine frame of the main machine. Both machine frames can then be connected to each other via connection elements, like screws, but ultimately form independent units. Main machine is also understood to mean the machine part with which "ordinary bags" can be fully produced.

In another embodiment of the invention it is proposed that a delivery cylinder be mounted in the machine frame in which the second tear-off station is arranged. Additional practical examples of the invention are apparent from the substantive description and the additional claims.

DETAILED DESCRIPTION OF THE PREFERRED EMBODIMENTS

Further scope of applicability of the present invention will become apparent from the detailed description. given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
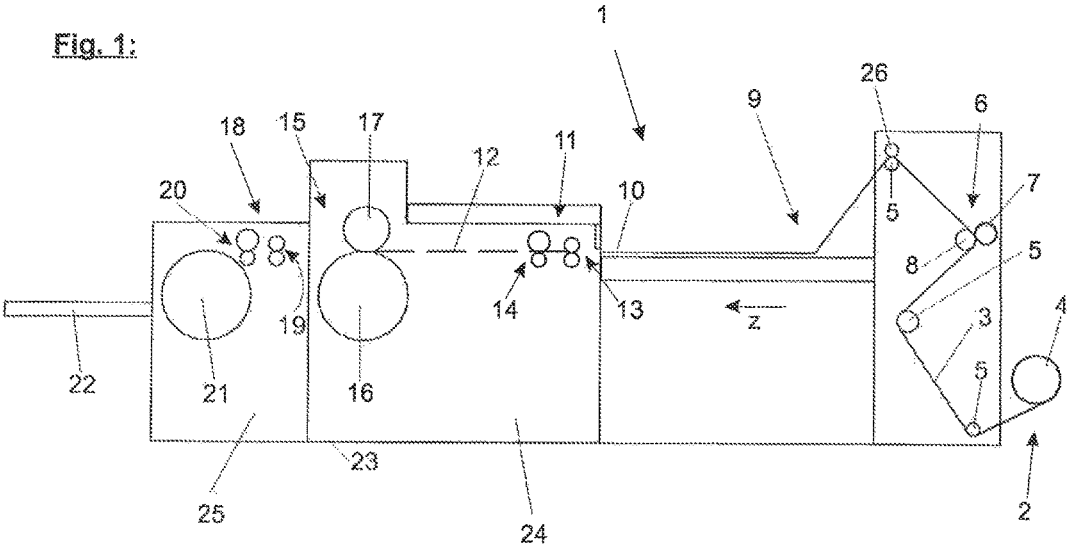
FIG. 1 shows a side view of a first variant of a device according to the invention

FIG. 1 shows a device 1 for production of bags. The essential components of this device are depicted schematically in this figure. The device 1 includes an unwinding device 2, to which a material web 3 in the form of a reel 4 is fed. Starting from this reel 4, the web 3 passes over guide rolls 5 of the crosscut station 6 or perforation station 6. This station 6 includes one or more crosscutting or cross-perforating blades (not further shown) which revolve on a roll 7. The material web 3 in this station 6 runs over a counter-pressure roll 8, which primarily has the purpose of providing the counterpressure necessary for the cutting or perforation process. In this cutting or perforation process the web is not penetrated, but provided with weakening cuts or perforations along which the tube to be formed later tears for separation into tube pieces. The perforations for later tear-off of the material sections are also introduced to the material web in the described station 6. For this purpose the roll 7 has blades in certain areas arranged parallel to each other.

The material web 3 then passes through a roll gap, an additional guide roll 5 and a roll formed as longitudinal gluing 26. This applies glue to a side area of the material web 3 so that both side areas after tube formation, which is described below, are permanently joined to each other.

In the following tube formation station 9 a tube 10 is formed from material web 3 in which the web 3 is folded in laterally by means of guide elements, like guide plates, so that the edges of the material web overlap. The overlapping areas were already provided with appropriate glue by means of longitudinal gluing 26. During folding of the paper web gussets can also be introduced. Insertion of gussets, however, can also occur after tube formation. The tube 10 is now generally conveyed in the transport direction z. After the tube 10 has been produced, it is separated into tube pieces 12 in the tear-off station 11. For this purpose the tube 10 is passed through the roll gap of a first roll pair 13. During additional advance of the tube it reaches the roll gap of the second roll pair 14. The rolls of the second roll pair continuously or at least temporarily have a greater peripheral speed than the rolls of the first roll pair 13, whose peripheral speed advantageously corresponds to the transport speed of the tube 10. When the next perforation viewed form the leading end of the tube has passed through the roll gap of the first roll pair 13, the second roll pair 14 grasps the tube 10. This can occur by entry of the leading end of the tube into the roll gap of the second roll pair. The rolls of the second roll gap 14, however, can also be moved relative (for example, perpendicular) to the tube 10 and are placed against the tube. When the rolls of the second roll gap 14 lie against the tube, the tube tears along the cut or perforation that was introduced to the web in station 6.

The tube piece 12 torn from the tube now goes to the bottom gluing and bottom folding station 15. For this purpose the tube piece 12 is held on the bottom-maker cylinder 16. Through an appropriate element, for example, a rod, the leading tab of the tube piece, which is generally a component of the bottom and protrudes above the top, is folded so that parts of the lower layer after folding lie on the outside of the upper layer. The tab and/or the area of the outside of the upper layer on which the tab lies after folding is provided beforehand with an adhesive, for example, glue. For this purpose the glue application device is used, which is symbolized in FIG. 1 by the glue cylinder 17.

Figure 2:
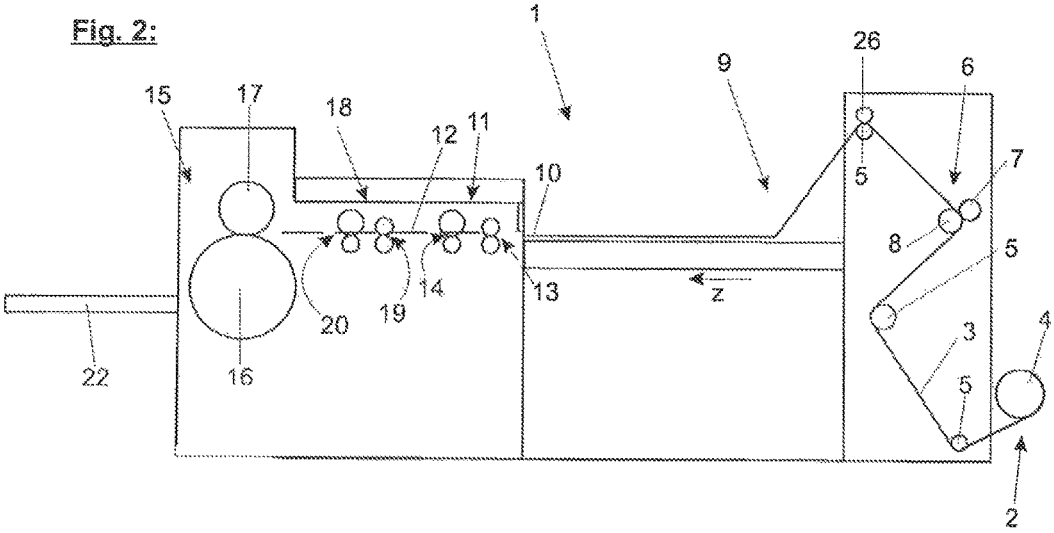
FIG. 2 shows a side view of a first variant of a device according to the invention

After the bag has been finished, it passes through a second tear-off station 18. This tear-off station 18 is therefore arranged after the bottom-maker cylinder 17. The station. is designed essentially like the first tear-off station 11 and operates in similar fashion. The spacings of the two roll gaps are adjusted so that the roll gap of roll pair 19 only grasps the material section of the upper layer, which extends above the lower layer, while the roll pair 20 ensures accelerated further transport of the bag. This material section is then advantageously taken off. After tear-off of said material section the bag is placed by means of a placing cylinder 21 on a table 22. The bag is then generally arranged upright. The bags can then be removed in stacks from this table 22. FIG. 2 shows another practical example of a device according to the invention. The basic functional principle does not differ from that of the device according to FIG. 1, for which reason the same elements also retain the same reference numbers. The second tear-off device 18 is now arranged in front of the bottom gluing and folding station 15 viewed in transport direction z. In this case the material section on the rear end of the tube section is torn off first before the bottom is made. The bags produced with the device according to the practical example depicted in FIG. 1 do not differ from the bags produced with the device according to the practical example depicted in FIG. 2.

The devices depicted in the two practical examples only differ with reference to the arrangement of the second tear-off station 18. In addition, in the practical example according to FIG. 2 the bottom-maker cylinder 16 simultaneously serves as placing cylinders so that a separate placing cylinder can be dispensed with. However, the second tear-off station must be considered from the outset in the design of a device according to the invention. In the practical example according to FIG. 1 the second tear-off station 18 can also be provided subsequently or optionally. This is shown in FIG. 1 by the separation line 23, with which it is indicated that the second tear-off station 18 and consequently the placing cylinder 21 can be positioned in a machine frame separated from the machine frame of the main machine 24, i.e., in the machine frame 25 of the second tear-off station. In principle, the second tear-off station can be provided with its own drive, which supplies the rolls of this tear-off station 18 with torque. Other possibly necessary elements of this tear-off station can also be supplied with power from this drive motor. The placing cylinder, if present, can be supplied with power or torque in this way. This separate drive is of particular advantage, if the device according to the invention is laid out according to FIG. 1. In this case a complete modular design is present, since the second tear-off station functions completely independently and can therefore provide a device for production of bags in the simple manner. However, a separate drive also has the advantage in the device according to FIG. 2 that the second tear-off station can be retrofitted.

Figure 3:
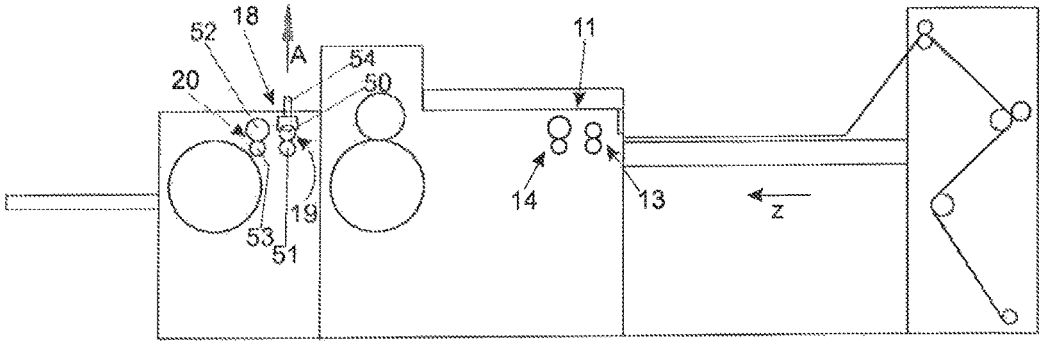
FIG. 3 shows a side view of another variant of a device according to the invention

FIG. 3 shows another device according to FIG. 1. In comparison with FIG. 1 the rolls of roll pairs 19 and 20 are given reference numbers. Roll 50 of roll pair 19 is then designed as a needle roll, which is further explained in FIG. 4. Roll 51 is laid out accordingly as a counterpressure roll, which includes recesses in which needles can enter. These recesses can be designed hole-like or as grooves. A stripping device configured as a suction device is provided above the needle roll 50, which has the purpose of removing a material section taken up by the needle roll 50 in the roll gap from the needle roll 50. The stripping device is not restricted to cooperation with a needle roll. It can also cooperate with other transport devices that are appropriate for carrying off a material section from the bag or tube section. Such a transport device can be a suction roll, for example.

Figure 4:
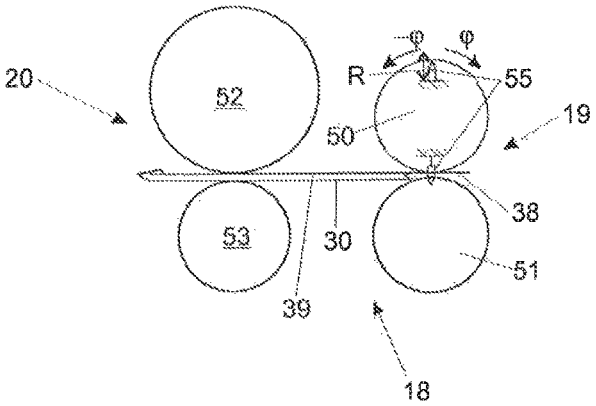
FIG. 4 shows a detail view of the second tear-off station

FIG. 4 shows an enlarged view of roll pairs 19 and 20. The roll 50 of roll pair 19 is equipped with needles 55, two of which can be seen. These needles 55 are mounted to move within roll 50 and are deployed from the peripheral surface of roll 50 right before or when they reach counterpressure roll 51. At this moment the material section 38 is to be grasped. Tear-off of material section 38 occurs either by holding by means of needles 55 or owing to the fact that the material section is held in the gap of rolls 50 and 51 or by both. If after further rotation of roll 50 the material section reaches the area of suction device 54, the needles 55 can be retracted into the body of roll 50 so that suction of the material section is facilitated. Deployment and retraction of the needles can occur through a guide surface (not shown). The needles for this purpose can be spring-loaded so that they are situated within the roll body in the base position. For deployment of the needles they can then run over a guide surface arranged so that the needles are forced outward against the spring force. However, the needles can also be moved differently in the direction of double arrow R, which gives the radial direction of roll 50. For example, controllable pneumatic cylinders are conceivable.

While needles 55 have grasped the material section 38, the bag 39 is already situated in the gap between rolls 52 and 53. The peripheral speed of these rolls is essentially equal to the transport speed with which the bag or tube pieces are transported through the device. The peripheral speed of rolls 50 and 51, at least in the period between grasping of material section 38 and tear-off, is less than this transport speed in order to permit tear-off at all. Since, however, the average peripheral speed, i.e., the path covered after a complete revolution of roll 50 divided by the corresponding time, must be equal to the transport speed, the roll 50 must be driven non-uniformly, i.e., with non-uniform angular or peripheral speed. This can occur for example via a known asymmetric gear mechanism or via a separate servomotor.

The phase position of rolls 50 is adjustable in the direction of arrows φ and −φ in order to be able to process tube pieces or bags of different formats.

FIG. 4 has thus far been described only in the context with an arrangement of the second tear-off station behind the bottom gluing and folding station 15. A second tear-off station, which is arranged before the bottom gluing and folding station 15 can operate in the same way.

Figure 5:
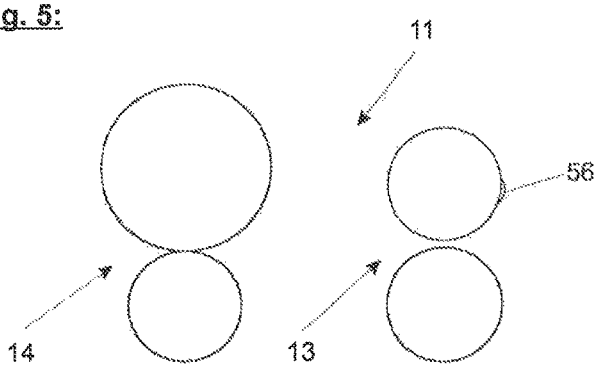
FIG. 5 shows a detail view of the first tear-off station

FIG. 5 shows the rolls of roll pairs 13 and 14 in a closer review. The upper roll of roll pair 13 has an elevation 56 on its peripheral surface. Only if the elevation reaches the gap of the rolls of roll pair 13 is the tube situated in it held between the rolls. In the same way the roll pair 14 can be configured. If the peripheral speed of the rolls of the roll pair 14 is now greater than that of roll pair 13, when a perforation has passed the roll gap 13, tear-off can occur. Generally, at least at the moment of tear-off, the rolls of the roll pair 14 run with a peripheral speed greater than the transport speed and the rolls of roll pair 13 run with a peripheral speed less than the transport speed of the tube, the tube piece or the bag in the device.

Figure 6:
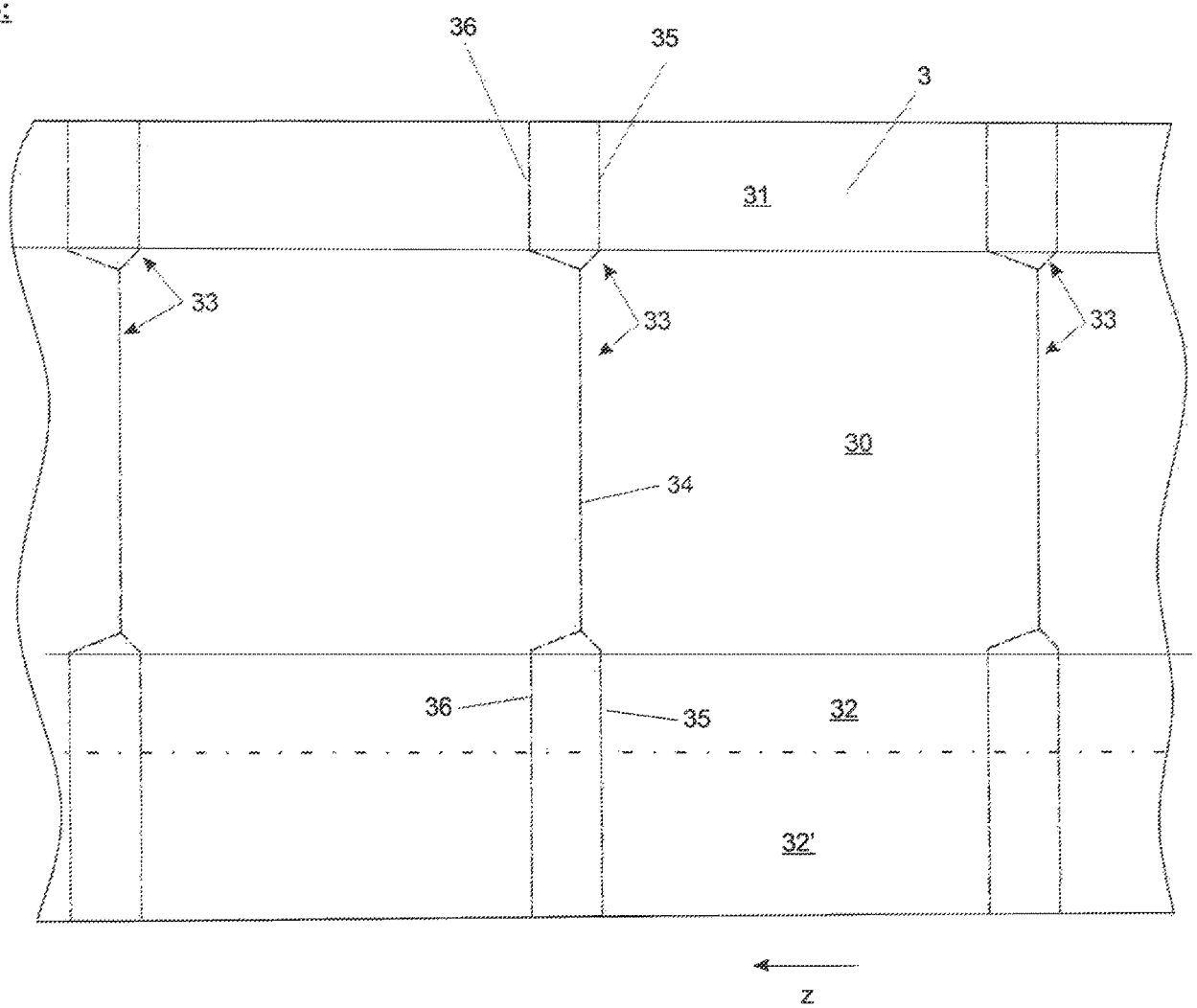
FIG. 6 shows a top view of material web provided with perforations

FIG. 6 shows the material web 3 after passing through the perforating station 6. The middle area 30 of this material web forms after passing through tube formation station 9 the lower layer of the tube or the later bag. The tube side areas 31 and 32, both of which can have different width, later form the upper layer of the finished bag. The side area 32 can also be divided into 32 and 32', area 32' including transparent material, preferably transparent plastic film. The material of which areas 30, 31 and 32 consists is a nontransparent material, preferably paper. The connection between the nontransparent material and the transparent material can already occur when the material web is wound onto the reel, which is later fed to the device as reel 4. Combining of the transparent and nontransparent material, however, can also occur within the device 1 according to the invention.

The material web 3 is provided with cross perforations 33, which are shown as dash-dot lines. These cross perforations are divided into an area 34 in which the perforation lies on a single line. This area lies essentially in the middle area 30 of the material web. In the other areas of the cross perforations this single perforation is divided into two parallel perforations 35, 36. The area between perforations 35, 36 forms the material section that is removed and taken off in the second tear-off station 18.

Figure 7:
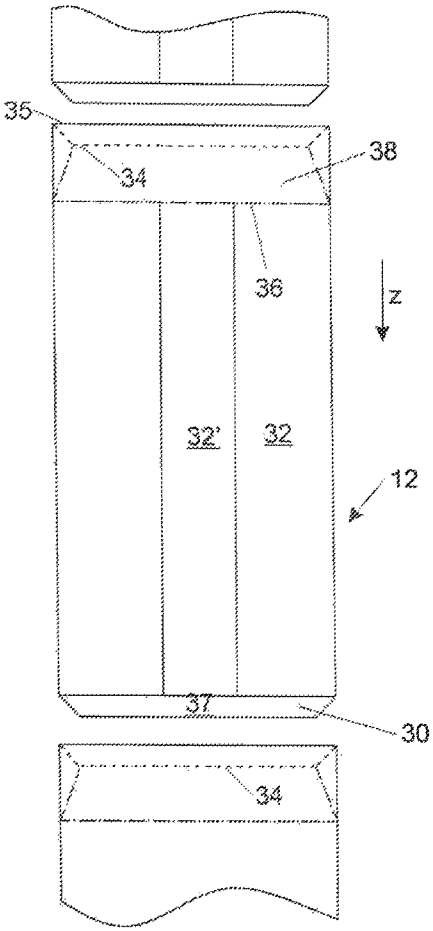
FIG. 7 shows a view of a tube piece that was separated

FIG. 7 shows the tube piece 12 that was produced by forming a tube from material web 3 according to FIG. 3 and by separation. Arrow z then indicates the transport direction. In the separation process the advancing sack tears off along the perforation line, which is formed by the perforation line sections 34 and 35. In order to ensure that the line section 35 and not the line section 36 actually tears, holding elements grip the material section 38 and ensure that the tube piece and the material section are further moved at the same speed. Even if the line sections 34 and 35 delimit the tube piece in FIG. 7, they are still drawn, edge 34 now being shown as a dashed line, since it represents an invisible edge. Viewed in the transport direction the lower layer 30 now protrudes above the upper layer, for which reason the front flap 37 is visible for the lower layer.

On the trailing end of the tube piece 12 the upper layer, which is formed by the side areas designated with reference numbers 31, 32, 32' in FIG. 6, protrudes beyond the end of the lower layer. The perforation 36 in this case is visible and therefore still shown with a dash-dot line. The perforation limits the material section 38 that is torn off in the second tear-off station 18 from the tube piece 12 or bag.

Figure 8:
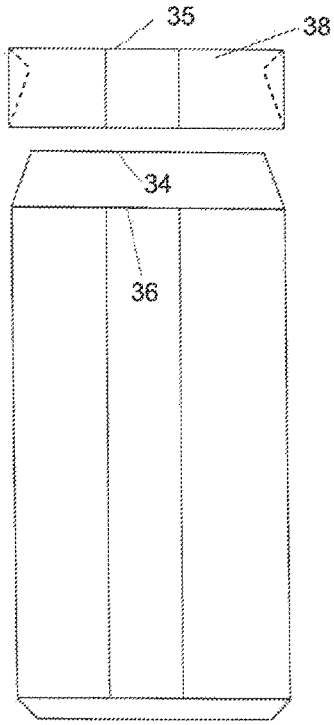
FIG. 8 shows a view of a tube piece in which a material section was torn off

FIG. 8 shows the tube section 12, from which the material section 38 has now been torn off. Now the lower layer protrudes beyond the upper layer not only on the front end, but also on the trailing end. The former perforation 36 now forms the closure edge of the upper layer. The former perforation 34 is now visible as the rear edge of the lower layer.

Figure 9:
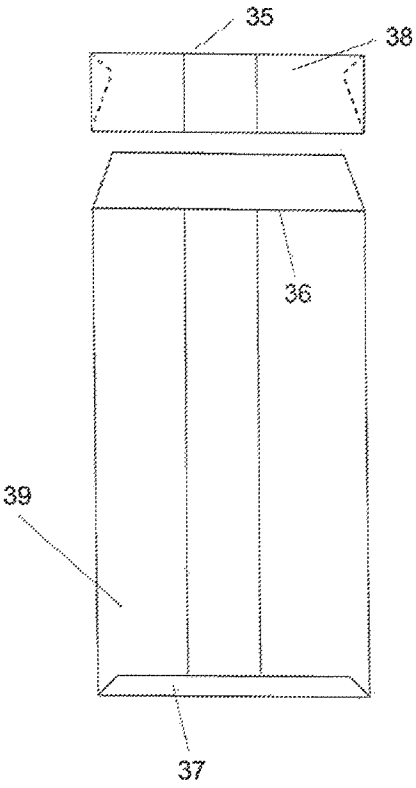
FIG. 9 shows a view of a finished bag

FIG. 9 shows the tube section 12 that was closed by folding of the front flap 37 on the upper layer and now represents a finished bag 39. It should be again pointed out here that a flat bag is depicted in FIGS. 7 to 9, which has no gussets. The described steps, however, can also be applied to gusseted bags, which are common for packing of baked goods, for example.

Figure 10:
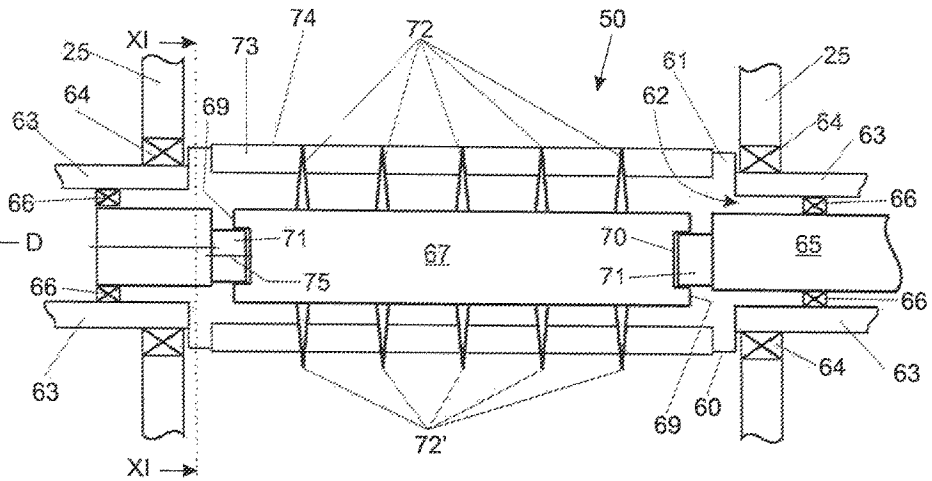
FIG. 10 shows a longitudinal section through a needle roll in a device according to the invention.

FIG. 10 shows a variant of the needle roll 50 and especially control of displacement of the needles within this needle roll.

Needle 50 initially includes a cylinder body 60 which is designed as a hollow cylinder and has a central opening 62 on its end surfaces 61. Another hollow cylinder 63 is fastened to an end on the outside. The cylinder body 60 and/or, as shown in FIG. 10, the hollow cylinder 63 are mounted to rotate in a bearing 64 in the machine frame 25. At least one of the hollow cylinders 63 can be acted upon by a drive with a torque. The drive can act, for example, on a toothed belt, which transfer the drive torque to the hollow cylinder 63 by means of gears, which therefore functions as a shaft.

Another cylinder 65 passes both through hollow cylinder 63 in the central opening and therefore extends into the internal space of the cylinder body 60. The hollow cylinder 63 can be supported via bearing 66 on the cylinder 65. This cylinder 65 could be attached to parts of the machine frame 25 that are not further shown, but can also be rotated relative to them. This rotation capability serves to adjust the needles relative to the outside surface of cylinder body 60, as described further below.

Figure 11:
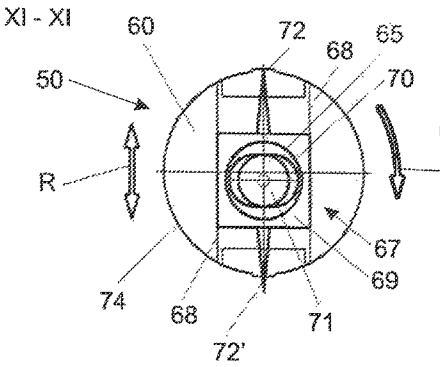
FIG. 11 shows view XI-XI from FIG. 10

In the cylinder body 60 needle support 67 is mounted to move in guide 68 so that it can be moved in the direction of the double arrow R relative to the cylinder body 60 (see FIG. 11). The guide 68 in the practical example depicted in FIG. 10 consists of two plane-parallel planes that represent sliding planes for the needle support. However, they can also be designed differently as long as they permit displacement of needle support in the direction of double arrow R. The needle support 67 carries a number of needles 72 on its two end side surfaces, which can pass through recesses 73 of the outside surface 74 of the cylinder body 60. On the ends 69 the needle support 67 has elliptical recesses 70. Rolls 71 engage in these elliptical recesses 70, which are fastened to the end of the cylinder 65 facing the needle support 67 in which the axis 75 of roll 71 is not flush with the axis of cylinder 65 but arranged eccentric to it. The roll can be arranged rotatable on cylinder 65.

Figure 12:
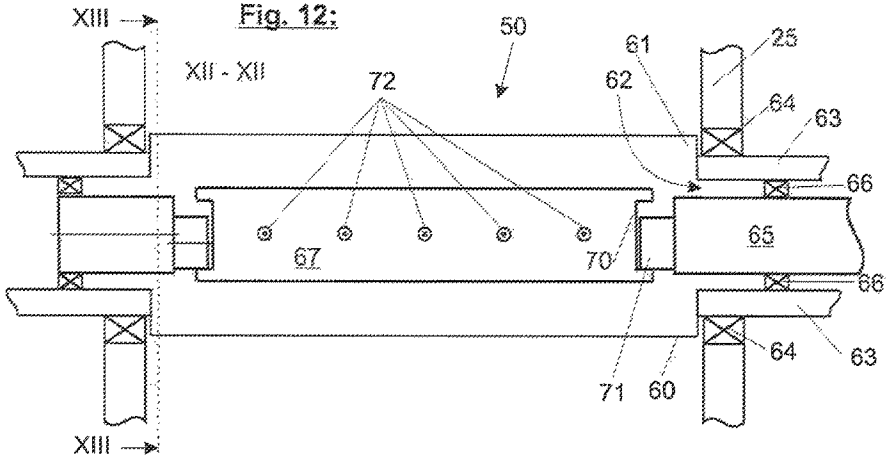
FIG. 12 shows needle roll from FIG. 10 but rotated by 90°

Previously only the first right end of the needle roll 50 was described with reference to FIG. 10. The second left end is designed similarly. However, devices for acting upon the roll with a torque can be dispensed with here. FIG. 12 shows the same roll as in FIG. 10 but further rotated by an angle of 90°.

Figure 13:
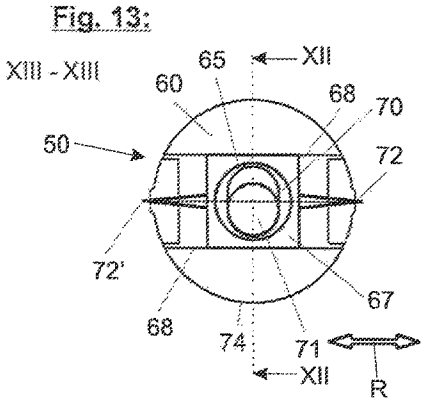
FIG. 13 shows view XIII-XIII from FIG. 12

The function of needle roll 50 can be explained with reference to FIGS. 11 and 13. In the initial position the upper needles, which are in the so-called 12 o'clock position, are completely lowered into the cylinder body 60. The lower needle 72' (6 o'clock position), on the other hand, are deployed as far as possible and then extend beyond the outer surface 74 of cylinder body 60. The needles 72' in this position are capable of grasping a material section 38. If the cylinder body 60 is rotated according to arrow D, the roll 71 remains in this position, as described. The elliptical recess 70, however, rolls with the outsides on roll 71. Since the needle support is not freely movable but can only be moved in the direction of arrow R, the needle support 67 is acted upon by the effect of roll 71 and the outsides of the elliptical recess 70 with a resulting force that points in direction R.

In order to be able to change the angular position in which the needles 72 or 72' are deployed as far as possible in the direction φ or −φ (see FIG. 4) the cylinder 65 can now be rotated relative to the machine frame. This is even possible during operation of the device according to the invention. With rotation of cylinders 65 the axis of rotation 73 or roll 71 is pivoted around the same angle amount, which means that the position in which needle 72 and 72' can be deployed as far as possible is also changed by this angle amount. If, for example, the cylinder 65 is rotated by 30° counterclockwise, the position in which needle 72 and 72' can be deployed as far as possible is changed to the so-called 5 o'clock position.

The situation after a quarter-revolution (rotation by 90°) is shown in FIG. 12. The main axis of inertia of the needle support 67 is now situated on the axis of rotation of cylinder body 67. The needle 72 and the needle 72' therefore extend equally far from the cylinder body. Subsequently during rotation the needles 72' are increasingly retracted into the cylinder body so that the material section that is held by needle 72' on the peripheral surface of the cylinder body is released again. The complete release of this material section occurs in the area of suction device 54 so that the material section can be reliably removed from the second separation station.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE NUMBERS

1 Device for production of bags
2 Unwinding device
3 Material web
4 Reel
5 Guide roll
6 Crosscutting station/perforating station
7 Roll
8 Counterpressure roll
9 Tube formation station
10 Tube
11 First tear-off station
12 Tube piece
13 First roll pair/holding roll pair
14 Second roll pair/tear-off roll pair
15 Bottom gluing and folding station
16 Bottom-maker cylinder
17 Glue cylinder/folding blade
18 Second tear-off station
19 Roll pair
20 Roll pair
21 Placing cylinder
22 Table
23 Separation line
24 Machine frame of the main machine
25 Machine frame of the second tear-off station
26 Longitudinal gluing
27
28
29
30 Middle area/lower layer
31 Side area
32, 32' Side area
33 Cross perforation
34 Area of perforation
35 Perforation
36 Perforation
37 front flap/tab
38 Material section
39 Bag
50 Needle roll
51 Counterpressure roll
52 Tension roll
53 Counterpressure roll
54 Suction device
55 Needles
56 Elevation
57
58
59
60 Cylinder body
61 End surfaces
62 Central opening
63 Hollow cylinder
64 Bearing
65 Cylinder
66 Bearing
67 Needle support
68 Guide
69 End of needle support 67
70 Elliptical recess
71 Rolls
72 Needles
73 Recess
74 Outer surface
75 Axis of rotation of roll 71
z Transport direction of tube
A Suction direction
φ Peripheral direction R Radial direction; direction of displacement of needle support 67

D Direction of rotation of cylinder body 60

What is claimed is:

1. A device for production of bags that consist mostly of paper, comprising:

a perforation device that cross perforates a material web, a tube formation device that forms a tube from the material web, a first separation device including a first roll pair and a second roll pair that separates individual tube sections along perforation lines, with an upper layer of the separated tube section protruding beyond a lower layer thereof at a trailing edge of the separated tube section, including after the separated tube section has left the first separation device, a device that forms a bottom on a leading end of the separated tube section by folding over a leading flap which is a part of the lower layer and which protrudes beyond the upper layer, and a second separation device that tears off along perforation lines an individual material section from the tube section, the second separation device including a first roll pair and a second roll pair, and (i) being spaced from the first separation device in a transport direction (z) of the tube, with which the material section is torn off when the tube section has left the first separation device, and operating independently of the first separation device, and (ii) including a removal device that removes the material section, (iii) with rolls of the second separation device second roll pair, which is located downstream of the second separation device first roll pair in the direction of transport (z) of the tube sections, being operated with a peripheral speed that corresponds to a transport speed of the tube sections, and with the material section being grasped by the second separation device first roll pair, with one of the rolls thereof being a needle roll, which is to grasp only the material section of the upper layer, and which is operated, at least at a moment of grasping of the material section, with a reduced peripheral speed relative to the transport speed of the tube sections, or (iv) with the second separation device first roll pair having a roll gap, and the second separation device second roll pair having a roll gap, and the second separation device first roll pair roll gap is to grasp only the material section of the upper layer, while the second separation device second roll pair provides for accelerated further transport of the bag, wherein to effect the separation of the material section.

2. The device according to claim 1, wherein the second separation device is located downstream in the transport direction (z) of the device to form the bottom.

3. The device according to claim 1, wherein the second separation device is located upstream in the transport direction (z) of the device to form the bottom.

4. The device according to claim 1, wherein the first separation device includes a holding device that grasps the material section, wherein the material section is at rest relative to the tube section which is still associated with the material section.

5. The device according to claim 1, wherein the second separation device is driven by a separate drive.

6. The device according to claim 1, wherein the second separation device is arranged in a machine frame independent from a machine frame of the first separation device.

7. The device according to claim 6, further comprising a placing cylinder arranged in the independent machine frame of the second separation device.

* * * * *